US005168023A

United States Patent [19]

Mitani et al.

[11] Patent Number: 5,168,023

[45] Date of Patent: Dec. 1, 1992

[54] PHOTOSENSITIVE ELEMENT USED IN ELECTROPHOTOGRAPHY

[75] Inventors: Tsutomu Mitani, Akashi; Hirokazu Nakaue, Higashiosaka; Hideo Kurokawa, Katano, all of Japan

[73] Assignee: Matsushita Electric Industrial Co., Ltd., Osaka, Japan

[21] Appl. No.: 724,887

[22] Filed: Jul. 2, 1991

[30] Foreign Application Priority Data

Jul. 4, 1990 [JP] Japan ..... 2-176709
Sep. 17, 1990 [JP] Japan ..... 2-247714

[51] Int. Cl.[5] ..... G03G 5/047; G03G 5/14; G03G 5/147

[52] U.S. Cl. ..... 430/58; 430/66; 430/67

[58] Field of Search ..... 430/58, 59, 66, 67

[56] References Cited

U.S. PATENT DOCUMENTS

| | | | |
|---|---|---|---|
| 4,403,026 | 9/1983 | Shimizu et al. | 430/66 X |
| 4,420,547 | 12/1983 | Nishikawa | 430/66 X |
| 4,837,137 | 6/1989 | Aizawa et al. | 430/66 X |
| 4,939,056 | 7/1990 | Hotomi et al. | 430/58 X |

FOREIGN PATENT DOCUMENTS

| | | | |
|---|---|---|---|
| 55-167262 | 11/1980 | Japan . | |
| 57-114146 | 7/1982 | Japan . | |
| 59-104667 | 5/1984 | Japan . | |
| 61761 | 4/1985 | Japan | 430/66 |
| 61-266567 | 5/1985 | Japan . | |
| 61-255352 | 11/1986 | Japan . | |
| 61-264355 | 11/1986 | Japan . | |
| 62-053786 | 3/1987 | Japan . | |
| 192753 | 8/1987 | Japan | 430/66 |
| 226158 | 10/1987 | Japan | 430/66 |
| 226558 | 12/1987 | Japan | 430/66 |
| 63-25662 | 2/1988 | Japan . | |
| 118754 | 5/1988 | Japan | 430/66 |
| 214870 | 8/1989 | Japan | 430/66 |
| 225960 | 9/1989 | Japan | 430/66 |

*Primary Examiner*—Roland Martin
*Attorney, Agent, or Firm*—Wenderoth, Lind & Ponack

[57] ABSTRACT

A photosensitive body has an electrically conductive substrate, and a photoconductive film formed on the substrate. A multiple optical film is formed on the photosensitive layer. The multiple optical film allows permeation of light beams in specific wavelength. Further, a diamond-like carbon film is formed on the multiple optical film. The diamond-like carbon film has thickness of at least 1,500Å and Noop hardness of at least 1,000 kg/mm$^2$. The multiple optical film and the diamond-like carbon film are provided in order to improve resistance against wear, ozone, and light.

4 Claims, 11 Drawing Sheets

PHOTOSENSITIVE ELEMENT USED IN ELECTROPHOTOGRAPHY

BACKGROUND OF THE INVENTION

The present invention relates to a photosensitive body for electrophotography which may be used in, for example an electrophotographic copying apparatus or a laser printer.

As a result of the significant proliferation of a variety of word processors and personal computers in recent years, the market demand for image printing apparatuses such as electrophotographic copying apparatuses and printers has sharply grown. Furthermore, as a result of the successful commercialization of a variety of photoconductors electrophotographic printers using such photoconductors have achieved remarkable progress. In particular, modern electrophotographic copying apparatuses primarily make use of a photosensitive body for embodying electrophotographic operations. Image quality, copying speed, power consumption, cost, etc. are mainly dependent on the physical performance characteristics of the employed photosensitive body constituted from photoconductive material. On the other hand, speaking of printers, laser printers using electrophotographic photosensitive body attract attentions of the concerned.

For example, an electrophotographic photosensitive body used in an electrophotographic apparatus is described below. FIG. 20 is a sectional view of a conventional photosensitive body. A reference numeral 14 designates a substrate constituted from conductive material and a reference numeral 15 indicates a photosensitive layer composed of photoconductive material which exhibits photoconductivity upon exposure to an irradiated light beam. Conventionally, a photosensitive layer is made from an inorganic material like Se, Se-As, Se-Te, a-Si, or Cds and so on, or from a polynuclear aromatic compound like anthracene, or from an organic material like phthalocyanine, or polyvinyl carbazole and so on. A photosensitive layer made from organic material is generally called "OPC". OPC is particularly used in electrophotographic copying apparatuses operating at slow and medium speeds because of its reduced harmfulness, lower cost, reduced hardness and reduced sensitivity when compared to the inorganic photosensitive layers available today. Some of the most recent organic photosensitive layers have a photosensitivity equivalent to that of an inorganic photosensitive layer. Due to this advantage, the organic photosensitive layers are used in some of the copying apparatuses operating at a fast speed.

Referring to FIGS. 21(*a*) and (*b*), organic photosensitive layers 25,35 respectively consist of both a charge generating layer (hereinbelow referred to as CGL) 16 and a charge transfer layer (hereinbelow referred to as CTL) 17. There are two types of layer structures including the layer structure 25 (referred to as a CTL/CGL/substrate structure) having a laminate of types of layer structures a substrate 14, a CGL 16 and a CTL 17 arranged in this order, and the other layer structure 35 (referred to as a CGL/CTL/substrate structure) 35 having a laminate of a substrate 14, a CTL 17 and a CGL 16 arranged in this order. Of these, the former CTL/CGL/substrate structure is widely used. This is because the CTL 17 has 20 to 30 μm of thickness in contrast with the CGL 16 having 0.2 to 0.5 μm of thickness, and thus, the CTL 17 is more resistant against wear than the CGL 16. More particularly, any electrophotographic copying apparatus executes a copying operation by following four sequential processes including (1) allowing an ozonizer to charge the surface of a photosensitive layer, (2) forming an image on the surface of the photosensitive layer by executing a light-exposure process and a development process with toner, (3) transferring the image onto a copying paper which is brought into contact with the surface of the photosensitive layer, and (4) scraping off residual toner from the surface of the photosensitive layer by applying a blade thereof. While executing this four-step processes, the blade comes into strong contact with the surface of the photosensitive layer, and thus, it severely affects the resistance of the photosensitive layer against wear. In other words, the blade adversely affects the service life of the photosensitive layer. Therefore, it is desirable that the photosensitive layer be resistant against wear.

On the other hand, in order to adequately transfer carriers, the CTLs 17 of the organic photosensitive layers 25 and 35 must have semiconductor characteristics. Normally, a P-type CTL is used in place of N-type CTL transfer layer. This is because the N-type CTL cannot transfer charges very fast, and also, does not unstably function. When charging the surface of the photosensitive layer, both positive and negative charge systems may be used. However, when adopting the organic photosensitive layer as the photosensitive layer, since the N-type CTL cannot properly function itself as mentioned above, when introducing the positive charge system, an available photosensitive layer is solely composed of the CGL/CTL/substrate structure . On the other hand, when introducing the negative charge system, the other composition of the CTL/CGL/substrate structure is solely used.

Recently, a semiconductor laser of AlGaAs has become widely available as a light source employed in a laser printer. This is because the semiconductor laser is small in size and can simplify an optical system, thereby realizing a significant reduction in size and weight, also resulting in the advantage in a reduced production costs. On the other hand, any of the conventional semiconductor lasers available today oscillates in a wavelength region of 780 nm to 850 nm in the vicinity of near infrared regions, and based on this reason, the photosensitive layer receiving laser beam must have a sharp sensitivity throughout the near infrared regions.

Technical problems in the conventional electrophotographic photosensitive body are described below.

First of all, the most critical problem is the poor resistance of the photosensitive layer against wear through repeated printing operations. When operating any conventional electrophotographic copying apparatus, since a blade comes into contact with the surface of the photosensitive layer, the photosensitive layer on surface of a photosensitive drum easily incurs damage, thus quickly degrading the copying characteristics thereof. In particular, the organic photosensitive layer easily incurs damage. Since the organic photosensitive layer has such a short service life that merely lasts at most 20,000 sheets of the copying process, the user is obliged to often replace the photosensitive drum. Especially, poor resistance against wear is the most critical problem when using a positive-charge system photosensitive drum of the CGL/CTL/substrate structure. However, the positive-charge system photosensitive drum of the CGL/CTL/substrate structure is superior to the negative charge system photosensitive drum of CTL/CGL/substrate structure in that the positive-charge system photosensitive drum stably generates charges on the surface of the organic photosensitive layer, and the negative-charge system photosensitive drum generates noise in the reproduced image as a result of infiltration of charges from the substrate into the charge generating layer. Nevertheless, as described above, it is difficult to put the positive-charge system photosensitive drum of the CGL/CTL/substrate structure into practice, since the thickness of the CGL is 0.2–0.5 μm and the superficial wear and roughness deteriorate copied sheets.

Although a prior art proposed provides of a protective film made from a variety of polymers on the surface of the organic photosensitive layer in order to prevent damage from occurring, as typically disclosed in Japanese Laid-open Patent Publication No. 61-266567, for example, it has not yet yielded any convincing effect.

The next critical problem is the resistance of the organic photosensitive layer against ozonic atmosphere. Any conventional organic photosensitive layer incurs deterioration of photoelectric characteristics upon exposure to ozonic atmosphere for an extended time period. This results in lowered printing performance. To solve this problem, a system for quickly dissipating ozone from the neighborhood of the photosensitive drum has been proposed. Nevertheless, this system has not fully solved the problem. There was another idea of slightly abrading the surface of organic photosensitive layer by bringing a blade into contact with it in order to constantly remove an ozone-affected surface. However, it was quite difficult to control this abrading system in order to finely protect the surface of the organic photosensitive layer from incurring damage. Especially, in the case of the positive-charge system photosensitive drum of the CGL/CTL/substrate structure, since the thickness of the CGL is merely 0.2 to 0.5 μm, the abrading system cannot easily be put to practical use.

In addition, the photosensitive layer still has a problem in its resistance to light. The electrophotographic photosensitive drum executes copying processes to alternately receive charges and light-exposure in the dark. However, when light continuously irradiates the photosensitive drum, the photosensitive characteristics thereof deteriorate. In particular, photosensitivity of the organic photosensitive layer is severely affected, and then, the light-affected photosensitive layer is no longer workable. Deterioration of the photosensitivity of the organic photosensitive layer is caused by degradation of the CTL after being irradiated by light. This in turn lowers the running performance of the carrier to cause the photosensitivity to also lower, and conversely, the residual potential rises. This consequently reduces the service life of the photosensitive drum itself. To prevent the photosensitive drum from suffering from reduced photosensitivity, for example, a prior art disclosed in the Japanese Laid-Open Patent Publication No. 57-90636 proposes a method of preventing a photosensitive layer from deteriorating in photosensitivity to light of short wavelengths. On the other hand, since a variety of electrophotographic copying apparatuses are made available for personal use today, the photosensitive layer is very frequently exposed to room light. Taking this into account, it is essential for manufacturers to properly protect the photosensitive layer from lowering in photosensitivity for light in the visible-ray regions as well. Nevertheless, actually no effective measure has yet been taken to realize this, but instead, since any of conventional electrophotographic copying apparatuses is externally shielded from light, the user must be very careful to properly handle the photosensitive drum, but actually, it cannot easily be treated.

SUMMARY OF THE INVENTION

As mentioned above, in order to extend the service life and promote the use of an electrophotographic photosensitive body especially including an organic photosensitive layer, it is necessary to accomplish the following objects. The object of the present invention is to improve the resistance of an organic photosensitive film against wear, ozonic atmosphere, and light.

In order to accomplish the object, a photosensitive body of a first embodiment of the present invention comprises an electrically conductive substrate; a photoconductive film which is formed on the electrically conductive substrate and exhibits electrical conductivity when the photoconductive film is irradiated by a light beam; and a diamond-like carbon film formed on a part or a whole surface of the photoconductive film.

Further, a photosensitive body of a second embodiment of the present invention comprises an electrically conductive substrate; a photoconductive film which is formed on the electrically conductive substrate, wherein said photoconductive film is composed of a charge generating layer and a charge transfer layer, and a surface of said photoconductive film substantially consists of said charge generating layer; and a diamond-like carbon film formed on a top surface of said photoconductive film.

Furthermore, a photosensitive body of a third embodiment of the present invention comprises an electrically conductive substrate; a photoconductive film which is formed on the electrically conductive substrate and exhibits electric conductivity when the photoconductive film is irradiated by a light beam; and an optical film means which is formed on the photoconductive film and allows permeation of light beams in specific wavelength regions.

Moreover, a photosensitive body of a fourth embodiment of the present invention comprises an electrically conductive substrate; a photoconductive film which is formed on the electrically conductive substrate and exhibits electric conductivity when the photoconductive film is irradiated by a light beam; an optical film means which is formed on the photoconductive film and allows permeation of light beams in specific wavelength regions; and a diamond-like carbon film which is formed on the optical film means.

The first and second embodiments function as follows. The diamond-like carbon film has extreme rigidity and incomparable smoothness. Since the surface of the diamond-like carbon film is perfectly flat and smooth, the diamond-like carbon film is the optimal material to prevent the underlaid photoconductive film from wearing out in contact with a blade. Furthermore, the diamond-like carbon film has extremely high resistance against chemicals, and thus, it retains stable physical characteristics in ozonic atmosphere. Therefore, by providing the diamond-like carbon film as a protective layer to protect the surface of the underlaid photoconductive film, the resistance of the photoconductive against wear and ozonic atmosphere is improved. Therefore, the photosensitive body for an electrophotographic apparatus has a very long service life. Further, because the diamond-like carbon film effectively absorbs light beams having 400 nm through 700 nm of wavelengths to a certain extent, the resistance of the photosensitive body against light can be improved.

Next, taking the electrophotographic copying process for example, functional features of the photosensitive body according to the third embodiment of the invention are described below.

FIG. 6 graphically shows light permeable characteristics of the optical film means formed on the photoconductive film. Since a laser beam has about 780 nm of wavelength, the laser beam permeates through the optical film means. Even though the photoconductive film is exposed to light having wavelengths other than that of the laser beam, owing to the light permeability of the optical film means shown in FIG. 6, direct influence over the photoconductive film can effectively be shut off. Thus, the resistance of the photosensitive body against light can be remarkably improved. Also, there is less need to shut out room light to the photosensitive body. A resistance value of at least $10^{11}\Omega$ is needed for the surface of the optical film means. If the surface resistance value of the photoconductive film is below $10^{11}\Omega$, then the charged current will easily flow, and as a result, the copied image will blur.

The fourth embodiment of the invention provides a diamond-like carbon film on the optical film means which is formed on the photoconductive film. The diamond-like carbon film can fully protect the underlaid optical film means and the photoconductive film underneath the optical film means from being abraded in contact with peripheral members. FIG. 7 graphically shows light-absorbing characteristics of the diamond-like carbon film. Because the diamond-like carbon film is transparent with respect to light having about 780 nm of wavelength, and thus a laser beam fully permeates through the diamond-like carbon film, and therefore, the diamond-like carbon film does not adversely affect the function of the photoconductive film at all. The thickness of at least 1,500Å, more preferably 2,000Å should be provided for the diamond-like carbon film. If the diamond-like carbon film is too thin, it cannot serve as the protective film. Furthermore, the surface resistance value of at least $10^{11}\Omega$ should be provided for the diamond-like carbon film. If the surface resistance value was less than $10^{11}\Omega$, then, a phenomenon in which an image flows will occur.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

First Embodiment

Figure 1:
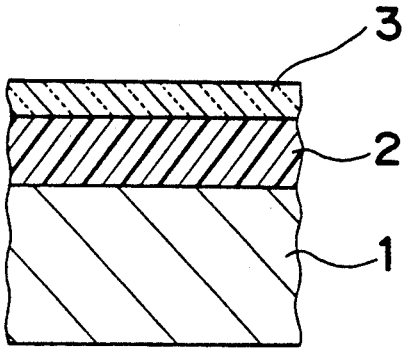
FIG. 1 is a sectional view of a photosensitive body used for an electrophotographic apparatus according to a first embodiment of the present invention.

FIG. 1 shows a first embodiment of the invention. A photosensitive layer 2 composed of a photoconductive film is formed on an electrically conductive substrate 1, where the photosensitive layer 2 exhibits conductivity upon exposure to irradiated light. A diamond-like carbon film 3 is formed on the surface of the photosensitive layer 2. A variety of studies have been reported on the method of synthesizing the diamond-like carbon film 3 (for example, see Japanese Laid-Open Patent Publication No. 63-270465). Any of such methods of synthesizing the diamond-like carbon film may be used for embodying the invention. However, utmost care should be taken to fully prevent physical characteristics of the photosensitive layer 2 from deteriorating as a result of the synthesis of the diamond-like carbon film 3 thereon. In particular, when the photosensitive layer 2 is composed of an organic photosensitive layer 2, because the organic photosensitive layer 2 is substantially soft and easily incurs damage, it is not preferable to make use of a method utilizing energy of irradiated ions.

The invention has been embodied by applying the plasma-injected chemical vapor deposition (CVD) process with a screen mesh (for example, see Japanese Laid-Open Patent Publication No. 1-198986). According to this process, gas containing carbon atoms like hydrocarbon is first converted into plasma, and then plasma irradiates a substrate covered with mesh-shaped electrodes each having specific potential lower than that of the plasma to complete the synthesis of rigid carbon film. According to this process, the diamond-like carbon film 3 can be synthesized on the surface of soft layer 2 made from organic photosensitive material easily incurring damage. This process is hereinafter called a screen-mesh plasma-injected CVD process.

The First Evaluation

First, a diamond-like carbon film 3 is synthesized on the surface of an organic photosensitive layer 2 by applying the screen-mesh plasma-injected CVD process, and then the resistance of the diamond-like carbon film 3 against abrading of a blade is evaluated after repeatedly sliding the blade on the organic photosensitive layer 2. In particular, damage symptoms and the growth of roughness on the surface of the organic photosensitive layer 2 are checked. Table 1 shows the test results.

TABLE 1

| Sample No. | Vicker's Hardness Hv (Kg/mm$^2$) | Thickness of diamond-like film (Å) | Surface roughness before test (μm) | Surface roughness after test (μm) |
|---|---|---|---|---|
| 1 | 700 | 100 | 0.02 | 1.5 (200 passes) |
| 2 | 700 | 500 | 0.02 | 1.5 (200 passes) |
| 3 | 700 | 1,000 | 0.02 | 1.8 (200 passes) |
| 4 | 700 | 3,000 | 0.02 | 1.4 (200 passes) |
| 5 | 1,000 | 100 | 0.02 | 1.0 (200 passes) |
| 6 | 1,000 | 300 | 0.02 | 0.5 (1000 passes) |
| 7 | 1,000 | 500 | 0.02 | 0.5 (2000 passes) |
| 8 | 1,000 | 1,000 | 0.02 | 0.05 (2000 passes) |
| 9 | 1,000 | 3,000 | 0.02 | 0.05 (4000 passes) |
| 10 | 2,000 | 100 | 0.02 | 1.8 (200 passes) |
| 11 | 2,000 | 300 | 0.02 | 0.5 (2000 passes) |
| 12 | 2,000 | 1,000 | 0.02 | 0.02 (5000 passes) |
| 13 | 2,500 | 100 | 0.02 | 0.05 (200 passes) |
| 14 | 2,500 | 500 | 0.02 | 0.03 (2000 passes) |

As understood from the above table 1, the resistance of the organic photosensitive layers 2 against abrading by the blade was remarkably improved in the case of organic photosensitive layers coated with the diamond-like carbon film 3 having a Vicker's hardness Hv of at least 1,000 kg/mm$^2$ and a thickness of at least 300Å. The thicker the diamond-like carbon film 3 becomes, the greater the resistance of the organic photosensitive layer 2 against abrading by the blade is. However, when the thickness of the diamond-like carbon film 3 exceeded 5,000Å, light-permeating characteristics of the diamond-like carbon film 3 fall to decrease the amount of light irradiating the organic photosensitive layer 2. As a result, photosensitivity of the organic photosensitive layer 2 lowers.

The organic photosensitive layer used for an electrophotographic copying apparatus exhibits photoconductivity when light having 40 nm through 700 nm of wavelength is irradiated. The organic photosensitive layer is most sensitive to light having 600 nm of wavelength. On receipt of incident light having 600 nm of wavelength, the diamond-like carbon film 3 having a thickness of 1,000Å allowed permeation of 90% of incident light and 70% of incident light when the diamond-like carbon film 3 had a thickness of 3,000Å. On the other hand, when the diamond-like carbon film 3 has a thickness of 5,000Å, the light-permeable rate falls to less than 50%. It is therefore understood that, when the diamond-like carbon film 3 has more than 5,000Å of thickness on the surface of the organic photosensitive layer, the amount of light irradiating the organic photosensitive layer sharply decreases, thus resulting in degrading the practical functioning of the photosensitive layers. For this reason, the thickness of the diamond-like carbon film 3 to be formed on the surface of the organic photosensitive layer **2*a* must be arranged in a specific range from 300Å to 5,000Å. Considering proper balance between the resistance against abrading by the blade and the photosensitivity, it is desired that the thickness of the diamond-like carbon film 3 is in a range from 1,000Å to 5,000Å. When Vicker's hardness Hv of the diamond-like carbon film 3 is less than 1,000 Kg/mm$^2$, the diamond-like carbon film 3 is not effective in improving the resistance thereof against abrading, regardless of the thickness of the diamond-like carbon film 3**.

On the other hand, the electrical resistance of the diamond-like carbon film 3 is an important item to be researched. If the diamond-like carbon film 3 having less than $1\times10^8\Omega$ cm of specific resistance value is used as a protective layer protecting the organic photosensitive layer 2, a charge cannot easily be provided thereon by an ozonizer and proper formation of an image becomes difficult. In this case, charged particles easily move on the surface of the photosensitive layer 2 when being exposed to light. This in turn causes a blur to easily occur in an image. To prevent this, it is desired that the diamond-like carbon film 3 is provided with at least $10^8\Omega$ cm, preferably at least $1\times10^{10}\Omega$ cm, of specific resistance value.

The Second Evaluation

First, a diamond-like carbon film 3 is synthesized on the surface of the organic photosensitive layer 2 by applying the screen-mesh plasma-injected CVD process, and then the resistance of the diamond-like carbon film 3 against ozone is evaluated. Concretely, experimental photosensitive bodies are laid in ozonic atmosphere generated by an ozonizer, and then the degraded photosensitivity relative to elapsed time is measured. Table 2 shows the test results.

TABLE 2

| Sample No. | Vicker's hardness Hv(Kg/mm$^2$) | Thickness of diamond-like film (Å) | Fallen photosensitivity (%) |
|---|---|---|---|
| 1 | 1,000 | 500 | 1.0 |
| 2 | 1,000 | 1,000 | 0.3 |
| 3 | 2,000 | 500 | 0.5 |
| 4 | 2,000 | 1,000 | 0.2 |
| 5 | — | 0 | 20.0 |

The test results proved that, after laying photosensitive bodies covered only with an organic photosensitive layer for about 40 hours in ozonic atmosphere, the photosensitivity of the organic photosensitive layer lowered to 80%. On the other hand, photosensitive bodies covered with the organic photosensitive layer coated with the diamond-like carbon film fully retained the photosensitivity which was unaffected even after being laid in the ozonic atmosphere for about 100 consecutive hours. The diamond-like carbon film synthesized by applying the screen-mesh plasma-injected CVD process is perfectly flat and smooth, and yet, rarely contains pin holes, and furthermore, is resistant to chemicals. It seems that these advantageous physical properties help increase the resistance of the organic photosensitive layer against ozone.

Taking the results of the first and second evaluations into account, by applying the screen-mesh plasma-injected CVD process, on the surface of an organic photosensitive layer provided on an electrically conductive substrate of a photosensitive drum is formed a diamond-like carbon film having the thickness of 1,000Å, Vicker's hardness Hv of 1,500 kg/mm$^2$, and specific resistance value of $3.5\times10^{12}\Omega$ cm, and then practical tests are executed with an electrophotographic copying apparatus. The test result proved that the tested photosensitive drums coated with the diamond-like carbon film is served more than 10 times the service life of photosensitive drums without being coated with the diamond-like carbon film.

It should be understood that the invention is not solely applicable to the organic photosensitive layer, but the invention also provides similar effects through its application to an inorganic photosensitive layer such as that made from Se or a-Si for example.

Second Embodiment

Figure 2:
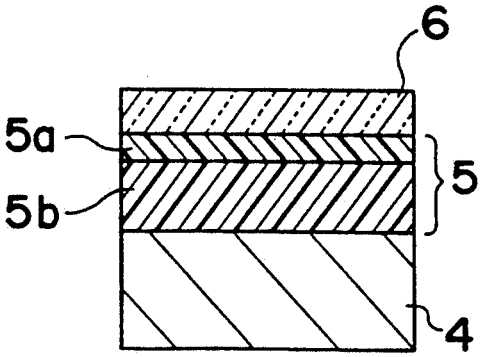
FIG. 2 is a sectional view of a photosensitive body used for an electrophotographic apparatus according to a second embodiment of the present invention.

FIG. 2 shows a second embodiment of the invention. An organic photosensitive layer 5 is formed on an electrically conductive substrate 4. The organic photosensitive layer 5 is composed of photoconductive film exhibiting photoconductivity upon exposure to irradiated light. Concretely, the organic photosensitive layer 5 includes a CGL 5*a* having a thickness of 0.3 μm and a CTL 5*b* having a thickness of 25 μm. The CTL 5*b* adjoins the surface of the electrically conductive substrate 4. A diamond-like carbon film 6 is formed on the surface of the CGL 5*a*. In order to synthesize the diamond-like carbon film 6, the screen-mesh plasma-injected CVD process is applied.

The Third Evaluation

A plurality of diamond-like carbon films of different hardness and thickness are synthesized on the surface of the organic photosensitive layers by applying the screen-mesh plasma-injected CVD process. Next, the resistance of the diamond-like carbon film against abrading by a blade is evaluated under a test condition in which the blade is pressed against the surface of the diamond-like carbon film on the organic photosensitive layer while repeatedly executing a sliding movement of the organic photosensitive layer and feeding toner to the surface of the diamond-like carbon film. The worn amount and the roughness of the surface were measured. Table 3 shows the test results.

TABLE 3

| Sample No. | Vicker's hardness | Thickness of diamond-like film (Å) | Surface roughness (μm) before test | Surface roughness (μm) after test |
|---|---|---|---|---|
| 1 | 700 | 100 | 0.02 | 1.5 (200 passes) |
| 2 | 700 | 500 | 0.02 | 1.5 (200 passes) |
| 3 | 700 | 1,000 | 0.02 | 1.8 (200 passes) |
| 4 | 700 | 3,000 | 0.02 | 1.4 (200 passes) |
| 5 | 1,000 | 100 | 0.02 | 1.2 (200 passes) |
| 6 | 1,000 | 300 | 0.02 | 1.0 (2000 passes) |
| 7 | 1,000 | 500 | 0.02 | 0.5 (2000 passes) |
| 8 | 1,000 | 1,000 | 0.02 | 0.05 (2000 passes) |
| 9 | 1,000 | 3,000 | 0.02 | 0.05 (4000 passes) |
| 10 | 2,000 | 100 | 0.02 | 1.8 (200 passes) |
| 11 | 2,000 | 300 | 0.02 | 1.0 (4000 passes) |
| 12 | 2,000 | 1,000 | 0.02 | 0.02 (5000 passes) |
| 13 | 2,500 | 100 | 0.02 | 1.0 (1000 passes) |
| 14 | 2,500 | 500 | 0.02 | 0.5 (4000 passes) |

According to the above test results, the organic photosensitive layer coated with the diamond-like carbon film having the thickness of at least 1,000Å and Vicker's hardness Hv of at least 1,000 kg/mm$^2$, is perfectly resistant to wear with the blade sliding. This proves that the resistance of the organic photosensitive layer to the abrading force of the blade is remarkably improved as a result of the coating with the diamond-like carbon film. The resistance of the organic photosensitive layer against wear is improved in proportion to the increase of the thickness of the diamond-like carbon film. However, if the thickness of the diamond-like carbon film exceeds 5,000Å, then, light permeable characteristics of the diamond-like carbon film decline in the case of specific light. This decreases the amount of light irradiating the organic photosensitive layer, thus resulting in deterioration of the photosensitivity.

Figure 3:
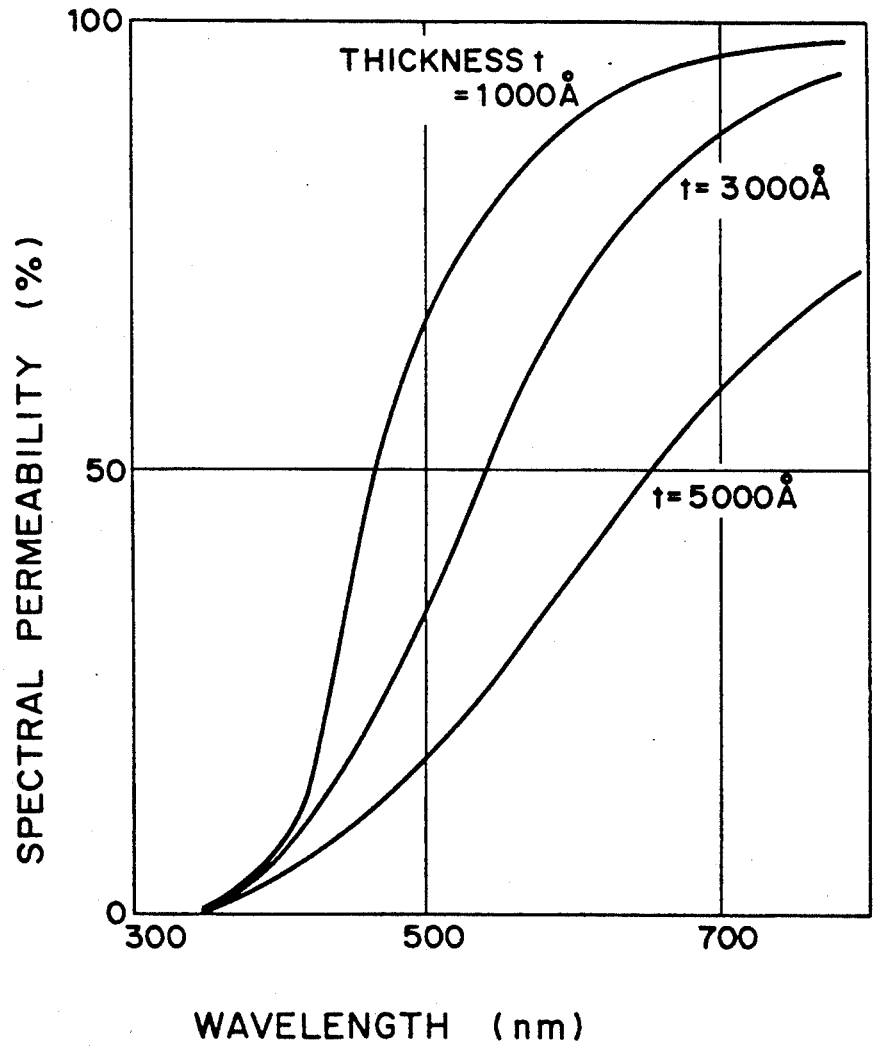
FIG. 3 is a graph showing the relation between wavelength and spectral permeability.

For example, when a light source generating visible rays such as a fluorescent lamp is applied, light having wavelengths of 300 nm through 700 nm irradiates the organic photosensitive layer. Upon receipt of light having wavelengths of 300 nm through 700 nm, as shown in FIG. 3, light permeable characteristics of the diamond-like carbon film decline. For example, in the case of light having a wavelength of 600 nm, the spectral permeability of the diamond-like carbon film of a thickness of 1,000Å becomes 90%. In the condition, the spectral permeability of the diamond-like carbon film having the thickness of 3,000Å declines to 70%, and the permeability of the diamond-like carbon film having a thickness of 5,000Å further declines to less than 50%. On the other hand, when applying a light source such as a semiconductor laser emitting light of wavelength of 780 nm which is frequently used for a laser printer, the diamond-like carbon film shows a light permeable characteristic much better than that of visible-ray light, thus offering a great advantage. It is preferable that the diamond-like carbon film is thin for permeability. However, the thickness of the diamond-like carbon film should properly be determined based on the balance between the permeability and the resistance against wear by carefully considering the specification of a blade and the kind of light source. However, as is clear from the result of the above evaluation, the diamond-like carbon film having less than Vicker's hardness Hv of 1,000 kg/mm$^2$ proves to be less effective to improve the resistance against wear, regardless of the thickness of the diamond-like carbon film.

On the other hand, an electric resistance value of the diamond-like carbon film is also one of the important factors. When a diamond-like carbon film having less than $1\times10^8\Omega$ cm of specific resistance value is used as a protective layer protecting an organic photosensitive layer, it is difficult to provide charge thereon by an ozonizer, thus resulting in a difficulty to properly form image. Furthermore, since the charged particles easily move in the organic photosensitive layer when being exposed to irradiated light, a shaped image tends to be blurred. Taking these factors into account, it is desired that the diamond-like carbon film for protecting the organic photosensitive layer have a specific resistance value of more than $10^8\Omega$ cm, preferably more than $1\times10^{10}\Omega$ cm.

The Fourth Evaluation

First, a diamond-like carbon film is synthesized on the surface of an organic photosensitive layer by applying the screen-mesh plasma-injected CVD process, and then the resistance of the organic photosensitive layer is evaluated against ozone. Concretely, photosensitive drums, that is, photosensitive bodies are laid in an ozonic atmosphere generated by an ozonizer, and then, degraded photosensitive characteristics of the photosensitive drums are measured relative to the ozone-exposed duration. Table 4 shows the test results.

TABLE 4

| Sample No. | Vicker's hardness Hv | Thickness of diamond-like film (Å) | Fallen photosensitivity (%) |
|---|---|---|---|
| 1 | 1,000 | 500 | 1.0 |
| 2 | 1,000 | 1,000 | 0.3 |
| 3 | 2,000 | 500 | 0.5 |
| 4 | 2,000 | 1,000 | 0.3 |
| 5 | — | 0 | 20.0 |

The photosensitive rate of the drums covered only with the organic photosensitive layer lowers to 80% after being exposed to the ozonic atmosphere for about 40 consecutive hours. On the other hand, the organic photosensitive layer coated with the diamond-like carbon film almost entirely retained the original photosensitivity even after being laid in the ozonic atmosphere for 100 consecutive hours. The diamond-like carbon film synthesized by applying the screen-mesh plasma-injected CVD process is perfectly flat and smooth, and yet, rarely has pin holes, and furthermore, is highly resistant against chemicals. It seems that these advantageous characteristics securely increase the resistance of the organic photosensitive layers against ozone.

The Fifth Evaluation

Taking the results of the third and fourth evaluations into account and applying the screen-mesh plasma-injected CVD process, on the surface of an organic photosensitive layer is formed a diamond-like carbon film having a Vicker's hardness Hv of 1,200 kg/mm$^2$, a specific resistance value of $3.5\times10^{12}\Omega$ cm, and a thickness of 2,000Å, and then practical tests are executed with an electrophotographic copying apparatus. It is confirmed that, even after executing 2,000 sheets of copying tests, the photosensitive drum coated with the diamond-like carbon film constantly generated a satisfactory image without degrading image quality at all. Furthermore, neither wear nor damage took place on the surface of the organic photosensitive layer. On the other hand, it was recognized that an image had been degraded after executing 1,000 sheets of copying test in the case of using a photosensitive drums without a diamond-like carbon film. It was difficult to fulfill a copying function beyond 2,000th sheets of copying test in that case. It is considered that the reason for this is as follows. That is, it is considered that a CGL of thickness of 0.3 μm was fully worn out at the time the copying operation was executed for 2,000 sheets, because wear of a photosensitive layer of a thickness of 4 μm had been observed after copying test of 20,000 sheets.

It should be understood that the invention is not limitative to the organic photosensitive layer, but the invention generates similar effects when being applied to an inorganic photosensitive layer composed of Se or a-Si for example.

Third Embodiment

Figure 4:
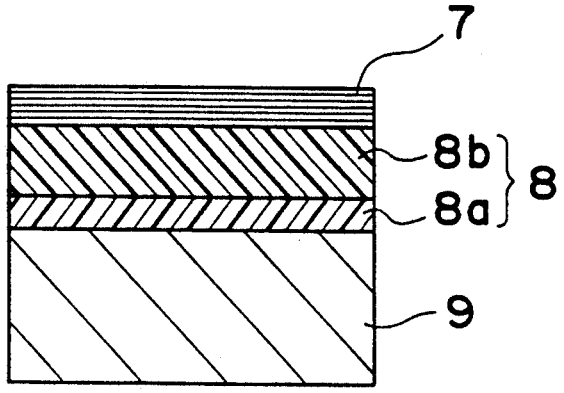
FIG. 4 is a sectional view of a photosensitive body used for an electrophotographic apparatus according to a third embodiment of the present invention.

FIG. 4 shows a third embodiment of the invention. An electrically conductive substrate 9 is made of aluminum. To the electrically conductive substrate 9 is applied an organic photosensitive layer 8 which is composed of a CGL 8*a* and a CTL 8*b*. The organic photosensitive layer 8 has about 20 μm of thickness. The CGL 8*a* adjoins the electrically conductive substrate 9. In addition, a multiple optical film layer 7 made from $TiO_2$ layers and $SiO_2$ layers are formed on the CTL 8*b*.

Figure 8:
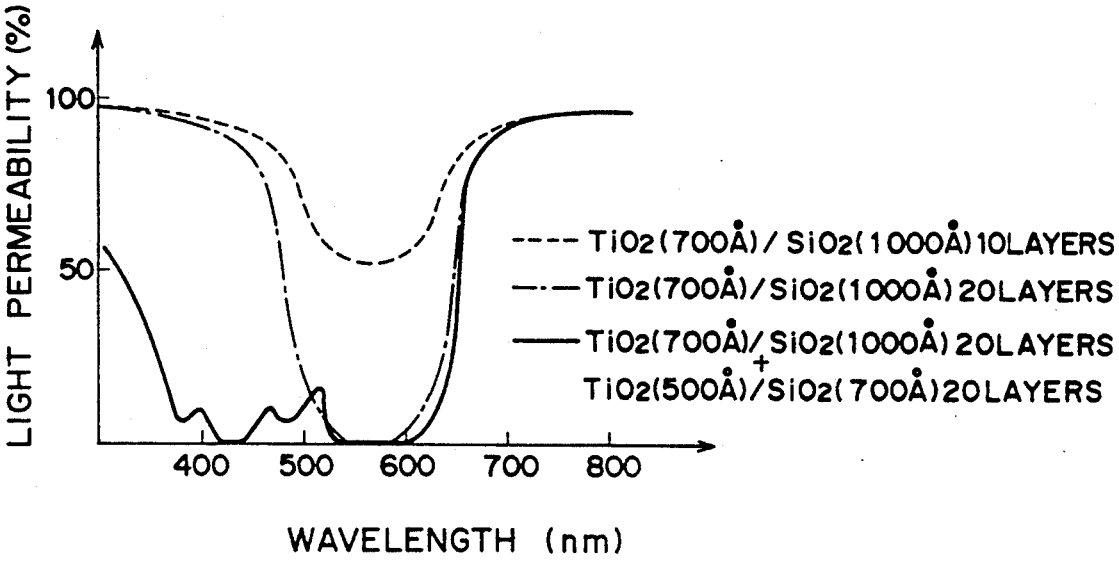
FIG. 8 is a graph showing light permeability of multiple optical films relative to wavelengths.
Figure 9:
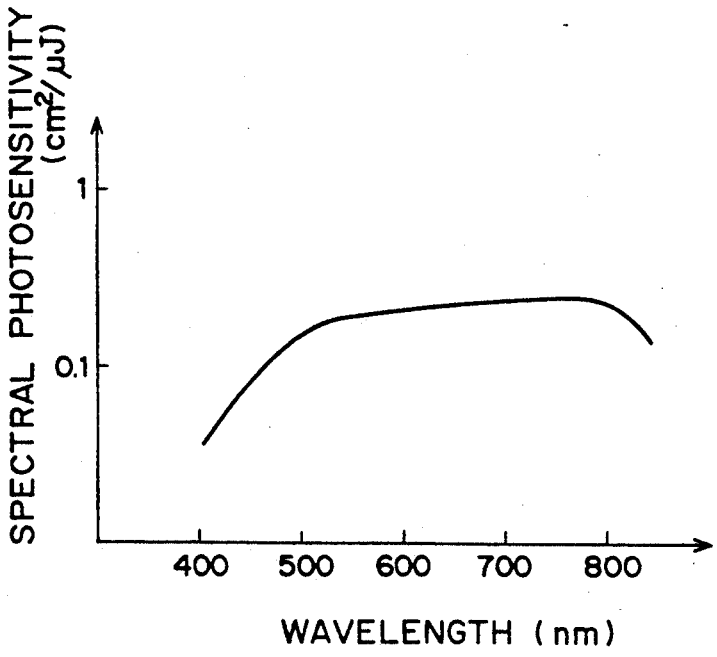
FIG. 9 is a graph showing spectral photosensitivity of a photosensitive layer.

Next, comparative tests were executed to prove the effect of the invention after preparing 4 kinds of samples. Sample No. P1 designates a sample which is covered with only an organic photosensitive layer; sample No. P2 represents a sample which has 10 stratums of films each having a $TiO_2$ layer having 700Å of thickness and a $SiO_2$ layer having 1,000Å of thickness; sample No. P3 represents a sample which has 20 stratums of films each having a $TiO_2$ layer having 700Å of thickness and a $SiO_2$ layer having 1,000Å of thickness; and sample No. P4 represents a sample which has the combination of 20 stratums of films each having a $TiO_2$ layer having 700Å of thickness and a $SiO_2$ layer having 1,000Å of thickness, and 20 stratums of films each having a $TiO_2$ layer having 500Å of thickness and a $SiO_2$ layer having 700Å of thickness. FIG. 8 graphically shows light permeable characteristics of multiple optical film layers each composed of $TiO_2$ layers and $SiO_2$ layers. FIG. 9 graphically shows a spectral sensitivity of a photosensitive layer.

Figure 10:
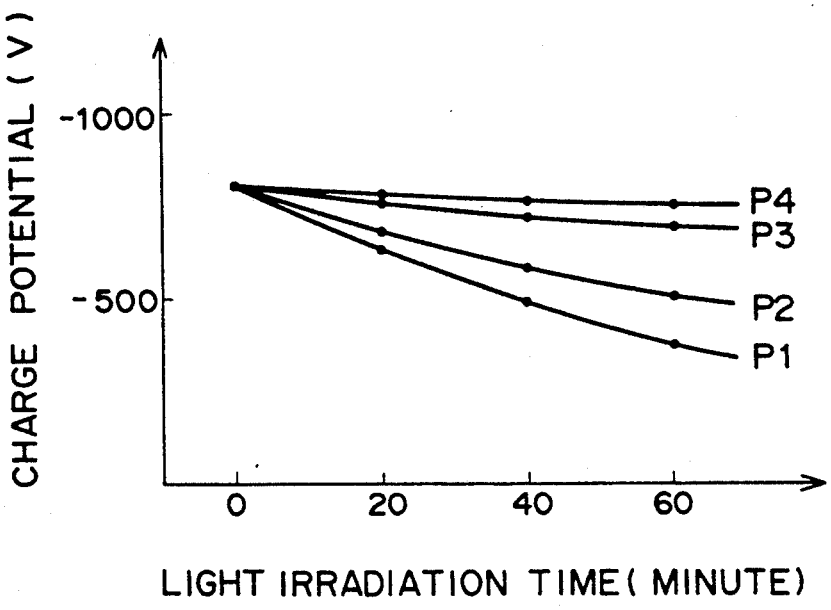
FIG. 10 is a graph showing the variation of charge potential relative to light irradiation time with respect to samples P1 through P4.
Figure 11:
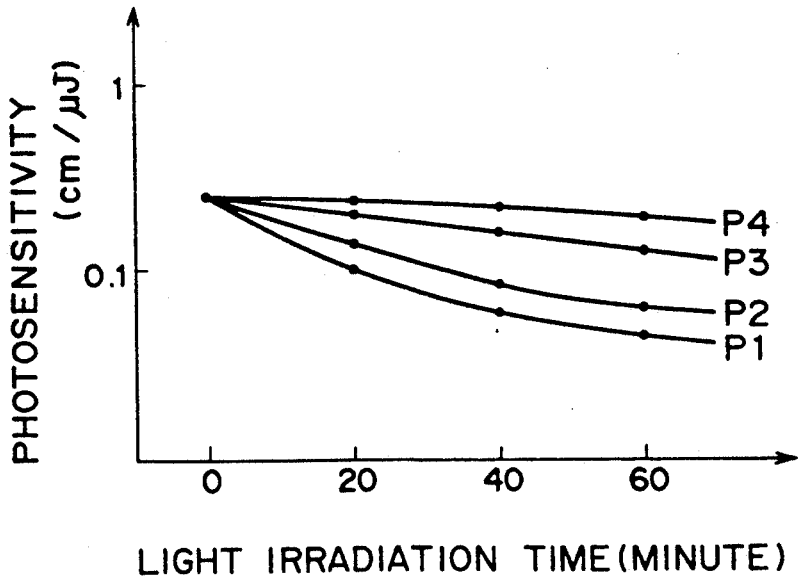
FIG. 11 is a graph showing the variation of photosensitivity relative to light irradiation time concerning samples P1 through P4.
Figure 12:
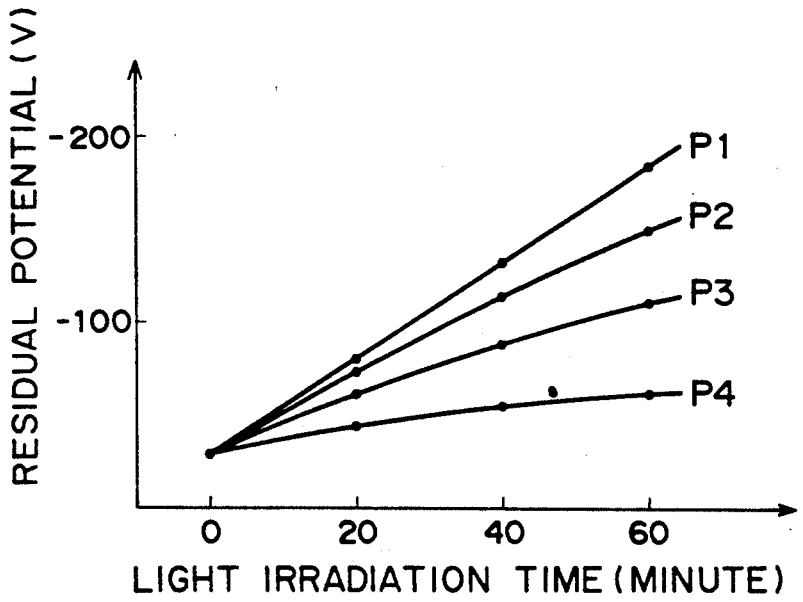
FIG. 12 is a graph showing the variation of residual potential relative to light irradiation time concerning samples P1 through P4.

Next, the four kinds of samples P1 through P4 are irradiated with 800 lux of white fluorescent light, and then deterioration in characteristics concerning charge potential, photosensitivity, and residual potential thereof relative to the duration of irradiation of white fluorescent light were checked. At the time, the irradiated white fluorescent light had a wavelength of 780 nm and power of 2 μw/cm$^2$. FIG. 10 shows the variation of charge potential relative to light irradiation time. FIG. 11 graphically shows the photosensitivity relative to light irradiation time. FIG. 12 graphically shows residual potential relative to light irradiation time. Each of these characteristics corresponds to light permeability on the top surfaces of photosensitive layers. It is understood from these results that those multiple optical layers showing less values of ligh permeability throughout extensive wavelength regions respectively provide less deterioration in characteristics. All the photosensitive layers have a surface resistance value in excess of $10^{13}$ to $10^{14}\Omega$.

Figure 13:
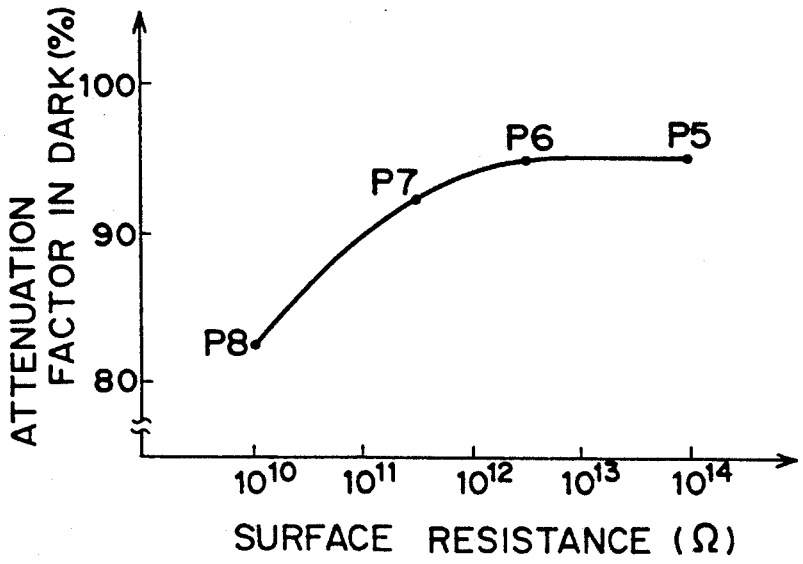
FIG. 13 is a graph showing the relation between surface resistance of a multiple optical layer and attenuation factor in the dark.

Next, 4 kinds of samples P5 through P8 were prepared. The samples P5 through P8 respectively have multiple optical layers each having $10^{10}$ through $10^{14}\Omega$ resistance values on the top surface, and then the attenuation characteristics of charge potentials thereof in the dark are detected. FIG. 13 graphically shows the relation between the surface resistance of multiple optical layers and attenuation factors in the dark. It is noted that the attenuation in the dark is large when the surface resistance value ranges from to $10^{10}$ to $10^{11}\Omega$.

Furthermore, 4 additional kinds of samples identical to the samples P1 through P4 were prepared, and then four cylindrical aluminum-made substrates were respectively coated with these additional four kinds of samples. After irradiating these samples for 30 minutes with 800 lux of a white fluorescent light beam, printing was executed with an actual printer. Then, the image condition of printed matter was checked before and after irradiation of light beam. Table 5 shows the test results.

TABLE 5

| Sample No. | Image Condition |
|---|---|
| P1 | Foggy symptom, deterioration of resolution |
| P2 | Somewhat foggy symptom |
| P3 | No change |
| P4 | No change |

In the case where a photosensitive layer was not covered, the image density formed on the photosensitive layer became thick due to degraded photosensitivity, in other words, a foggy symptom appeared. In consequence, fine lines of the document were not precisely reproduced, thus resulting in the deterioration of resolution.

On the other hand, in the case where the multiple optical film layers are provided, the less a light permeability becomes, the less the deterioration of the image becomes. Also, printing test was executed with drums superficially coated with samples P5 through P8 of multiple optical films which respectively have surface resistance values different from each other. Table 6 shows the test results.

TABLE 6

| Sample No. | Surface resistance value | Image Condition |
|---|---|---|
| P5 | $5 \times 10^{13}\ \Omega$ | Normal |
| P6 | $5 \times 10^{12}\ \Omega$ | Normal |
| P7 | $5 \times 10^{11}\ \Omega$ | Normal |
| P8 | $1 \times 10^{10}\ \Omega$ | Blur |

It is apparent that an image is blurred when the surface resistance value is at $10^{10}\Omega$. Therefore, in order to generate a normal image, it is desired that the surface resistance value shall be a minimum of $10^{11}\Omega$, preferably in excess of $10^{13}\Omega$.

It should be understood that the invention is not solely applicable to the organic photosensitive layer, but the invention generates identical effects even when using inorganic photosensitive layer made from Se or a-Si for example.

Fourth Embodiment

Figure 5:
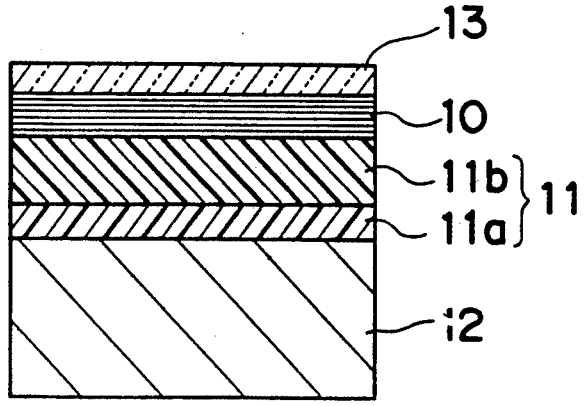
FIG. 5 is a sectional view of a photosensitive body used for an electrophotographic apparatus according to a fourth embodiment of the present invention.
Figure 6:
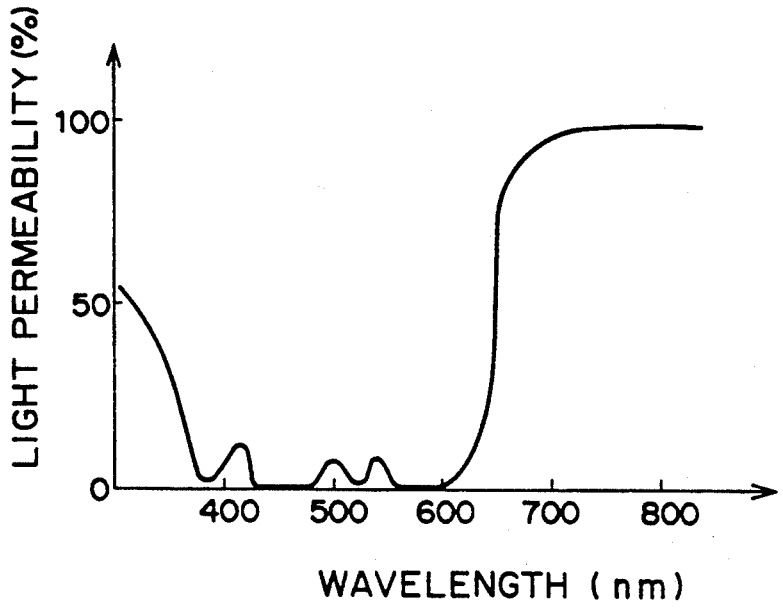
FIG. 6 is a graph showing the relation between wavelength and light permeability in an optical film or a multiple optical film.
Figure 7:
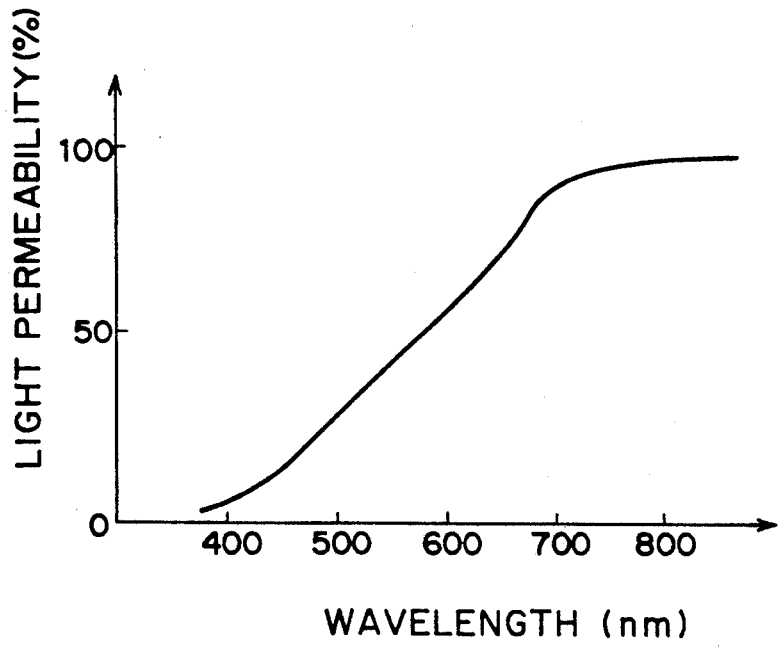
FIG. 7 is a graph showing the relation between wavelength and light permeability in a diamond-like carbon film.

Next, a fourth embodiment of the invention is described below. FIG. 5 shows a sectional view of a elecrophotographic photosensitive body. First, an aluminum-made substrate 12 is coated with an organic photosensitive layer 11 having a thickness of about 20 μm. The organic photosensitive layer 11 includes a charge generating layer 11*a* and a charge transfer layer 11*b* being formed on the substrate 12 in this order. Next, a multiple optical film 10 composed of $TiO_2$ layers and $SiO_2$ layers is formed on the charge transfer layer 11*b*, and then a diamond-like carbon film 13 is formed on the surface of the multiple optical film 10 by applying the screen-mesh plasma-injected CVD process.

4 kinds of samples P9 through P12 were prepared. In the sample P9, only an organic photosensitive layer is formed on an electrically conductive substrate. In the sample P10, a multiple optical film which is composed of $TiO_2$ layers and $SiO_2$ layers, is formed on the photosensitive layer. In the sample P11, a diamond-like carbon film is formed on the organic photosensitive layer. In the sample P12, a multiple optical film, which is composed to $TiO_2$ layers and $SiO_2$ layers, is formed on the photosensitive layer, and further a diamond-like carbon film is formed on the multiple optical film. In these samples P10, P12, each of the multiple optical films is composed of the combination of 20 strums of first layers each of which is composed of a $TiO_2$ layer having a thickness of 700Å and a $SiO_2$ layer having a thickness of 1000Å, and 20 strums of second layers each of which is composed of a $TiO_2$ layer having a thickness of 500Å and a $SiO_2$ layer having a thickness of 700Å.

The diamond-like carbon films of the samples P11, 12 respectively have a thickness of 200Å and a Noop hardness of 1200 kg/mm$^2$. Every sample P9–P10 has a surface resistance of $10^{13}$–$10^{14}\Omega$.

Figure 14:
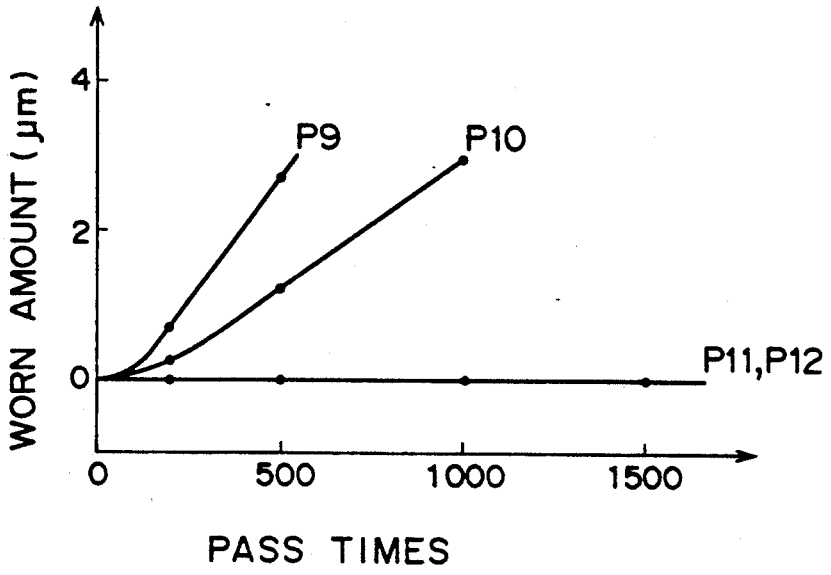
FIG. 14 is a graph showing the relation between pass times of a blade and worn amounts in samples P9 through P12.

Next, using these samples P9 through P12, a sliding test was executed in comparison with each other. While feeding toners to the surface of each sample, and pressing each blade against the surface of each sample with a load of 100 g, the sample was repeatedly slided to the blade. FIG. 14 graphically shows the relation between the number of sliding movements performed in the test and the worn amount on the surface of the tested samples. The samples P9, P10 devoid of the diamond-like carbon film on the surface were superficially abraded after completing from several scores up to 100 abrading tests. On the other hand, no wear was detected on the surface of the diamond-like carbon film even after completing 1,000 of the abrading tests.

Figure 15:
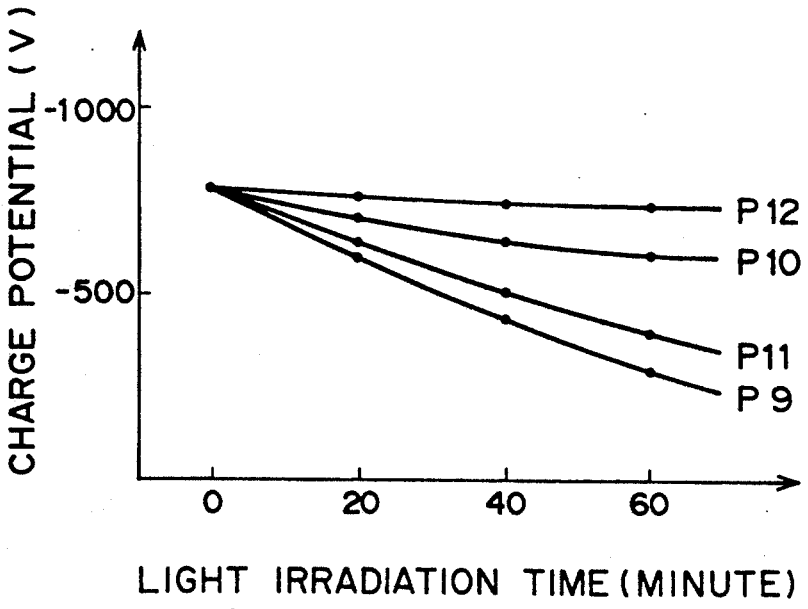
FIG. 15 is a graph showing the relation between light irradiation time and charge potential in samples P9 through P12.
Figure 16:
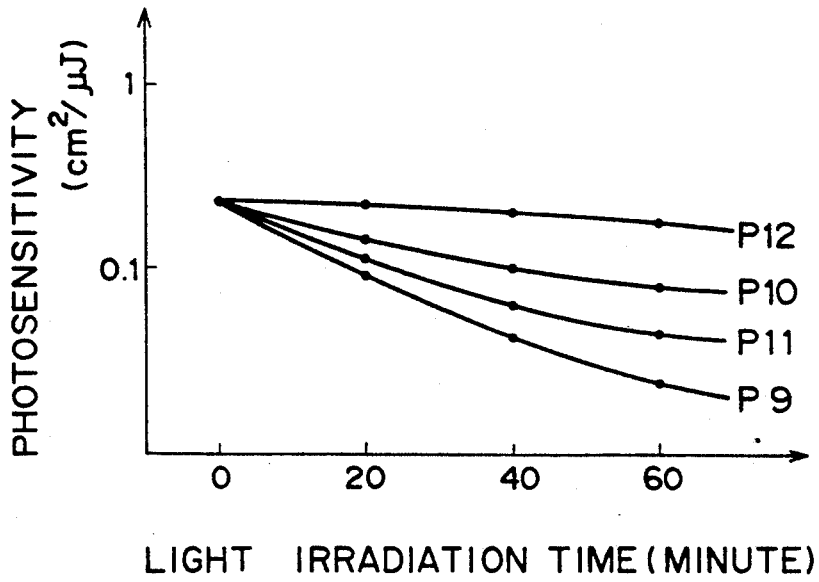
FIG. 16 is a graph showing the relation between light irradiation time and photosensitivity in samples P9 through P12.
Figure 17:
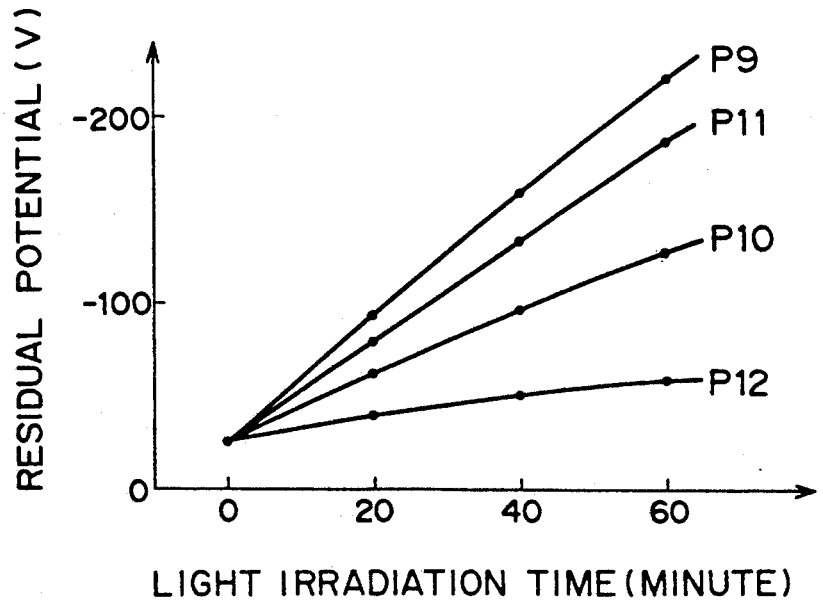
FIG. 17 is a graph showing the relation between light irradiation time and residual potential in samples P9 through P12.

After completing 500 rounds of the abrading test against those samples P9 through P12 with blades, variations of physical characteristics of those photosensitive layers were checked relative to the time of a irradiation of light beam while irradiating those samples with 800 lux of white fluorescent light beam. FIG. 15 shows charge potential relative to light irradiation time. FIG. 16 shows the photosensitivity relative to light irradiation time. FIG. 17 shows the relation between residual potential and light irradiation time. As shown in FIGS. 15, 16, and 17, top surface layers of the samples P9, P10 devoid of the diamond-like carbon film incurred abrasion, and thus, those characteristics including charge potential, photosensitivity, and residual potential, were noticeable deteriorated. Sample P9 having only a photosensitive layer was further remarkably deteriorated. Likewise, the sample P10 superficially coated with the multiple optical film was also worn out, thus resulting in the lowered resistance against degradation of photosensitivity. On the other hand, the samples P11, P12 which were superficially coated with the diamond-like carbon film, incurred no wear at all, and thus, those characteristics cited above remained unaffected after execution of the abrasion tests. In particular, the sample P12 which was superficially coated with the diamond-like carbon film in conjunction with the multiple optical film, remained free from deterioration of photosensitivity after completing the abrasion tests.

Next, three samples P13, P14 and P15 were prepared. In every sample P13, P14 and P15, a multiple optical film composed of $TiO_2$ layers and $SiO_2$ layers was formed on the organic photosensitive layer, and then was coated with a diamond-like carbon film having a Noop hardness of 1,000 kg/mm$^2$. The diamond-like carbon film of the sample P13 had a thickness of 1000Å. The diamond-like carbon film of the sample P14 had a thickness of 1500Å. The diamond-like carbon film of the sample P15 had a thickness of 2000Å.

Figure 18:
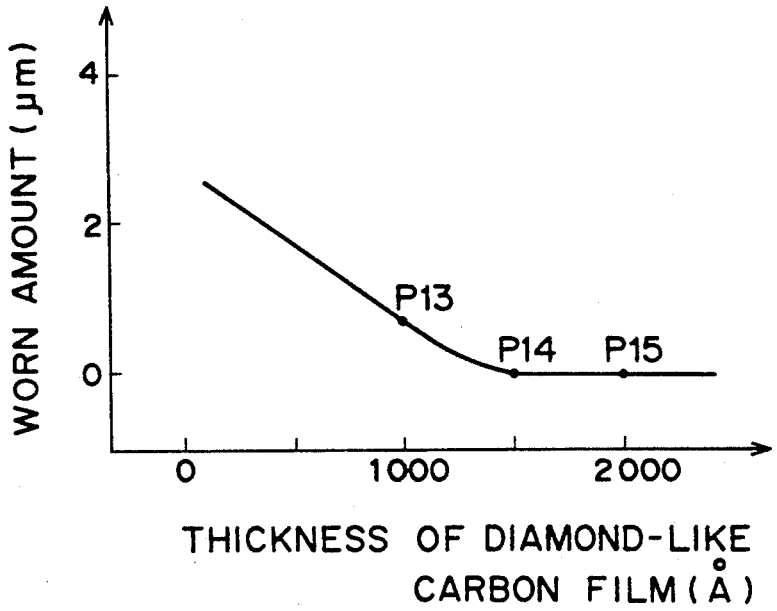
FIG. 18 is a graph showing the relation between thickness of diamond-like carbon film and the worn amounts thereof in samples.

Next, an abrasion test against these three samples P13 through P15 were executed in comparison with each other. FIG. 18 shows the relation between the thickness of diamond-like carbon film and the amount of wear on their surfaces. Based on these test results, it is clear that the thickness of at least 1,500Å should be provided for the diamond-like carbon film, and more than the thickness of 2,000Å should be provided so preferably underlaid photosensitive layers can fully be protected without incurring wear at all.

Next, three samples P16, P17, and P18 were prepared. In every sample P16, P17 and P18, a multiple optical film composed of $TiO_2$ layers and $SiO_2$ layers was formed on the organic photosensitive layer, and a diamond-like carbon film having a thickness of 2000Å was formed on the multiple optical film. The diamond-like carbon film of the sample P16 had a Noop hardness of 800 kg/mm$^2$. The diamond-like carbon film of the sample P17 had a Noop hardness of 1,000 kg/mm$^2$. The diamond-like carbon film of the sample P18 had a Noop hardness of 2,000 kg/mm$^2$.

Figure 19:
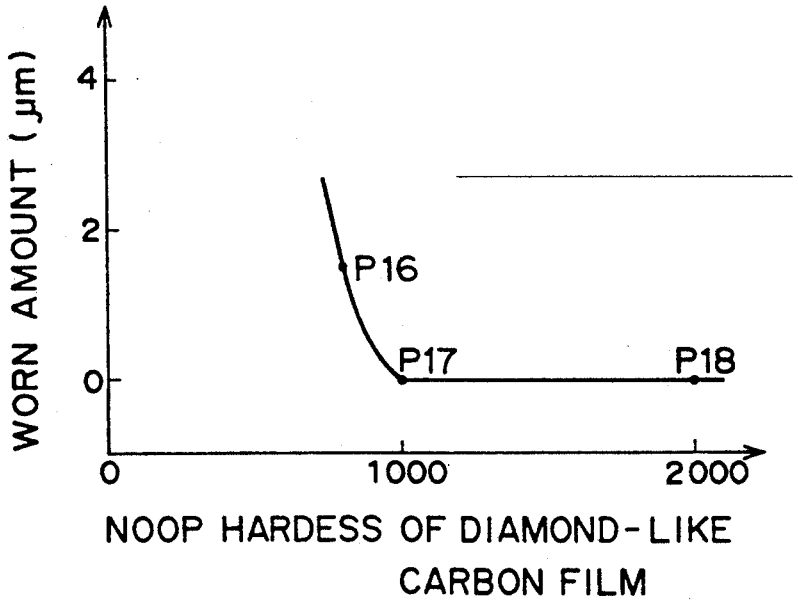
FIG. 19 is a graph showing the relation between Noop hardness of diamond-like carbon film and the worn amounts thereof.
Figure 20:
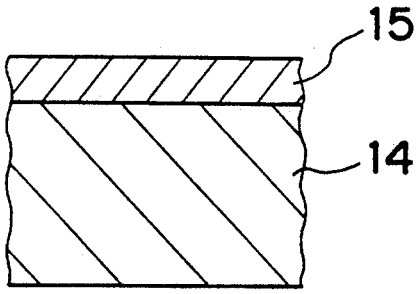
Fig. 20 PRIOR ART
FIG. 20 is a sectional view showing a photosensitive body of the prior art.
Figure 21A:
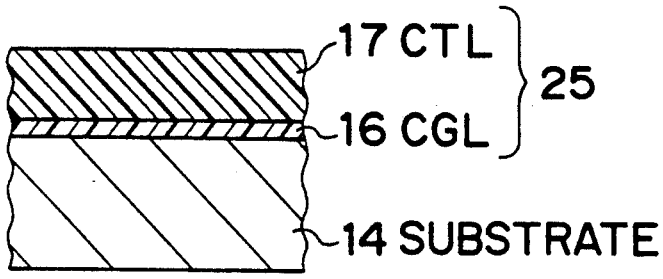
Fig. 21(a) PRIOR ART
FIGS. 21 (*a*) and (*b*) are sectional views showing photosensitive bodies which use an organic photosensitive layer respectively.
Figure 21B:
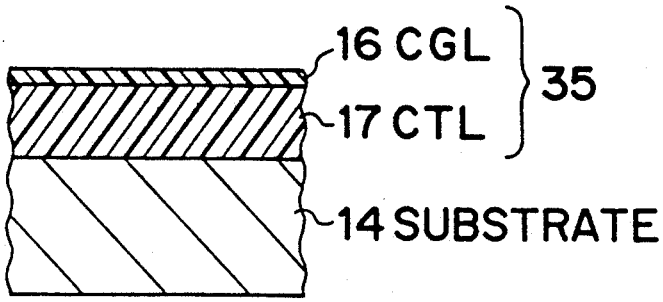
Fig. 21(b) PRIOR ART

Next, an abrasion test to these three samples P16 through P18 was executed for comparison purposes. FIG. 19 shows the relation between the Noop hardness of diamond-like carbon films and the amount of wear on their surfaces. Based on these test results, it is clear that the Noop hardness of at least 1,000 kg/mm$^2$ should be provided for the diamond-like carbon film.

Samples P19 through 22 were prepared, respectively having diamond-like carbon films of resistance of $10^{10}$–$10^{14}\Omega$.

As results of a attenuation test, the attenuation characteristics in the dark were obtained similarly to those in shown in FIG. 13. It is clear that the attenuation in the dark is remarkable in the range of resistance of $10^{10}$–$10^{11}\Omega$.

Additionally, samples P9 through P22 were prepared. These samples P9 through P22 respectively have the above mentioned compositions formed on cylindrical aluminum substrates and different surface resistance values, and then, the image conditions in those samples P9 through P12 are evaluated by actually running a printer.

Tables 7 and 8 indicates the results of the test.

TABLE 7

| Sample No. | Image Condition |
|---|---|
| P9 | Foggy Symptom, deterioration of resolution |
| P10 | Foggy Symptom, deterioration of resolution |
| P11 | Foggy Symptom, deterioration of resolution |
| P12 | No change |

TABLE 8

| Sample No. | Surface resistance value | Image condition |
|---|---|---|
| P19 | $5 \times 10^{13}\ \Omega$ | Normal |
| P20 | $5 \times 10^{12}\ \Omega$ | Normal |
| P21 | $5 \times 10^{11}\ \Omega$ | Normal |

TABLE 8-continued

| Sample No. | Surface resistance value | Image condition |
|---|---|---|
| P22 | $5 \times 10^{10}\ \Omega$ | Blur |

In the cases where the sensitive layers coated with either a diamond-like carbon film or a multiple optical film, the deterioration of image occurred. When the surface resistance value is less than $10^{10}\Omega$, an image apparently was blurred. Thus, it is possible to always produce a stable image by securely preventing photosensitivity of an organic photosensitive layer from incurring degradation for a long service time by effectively forming a multiple optical film on a photosensitive drum together with the synthesis of a diamond-like carbon film on the multiple optical film. Also, a single optical film is used in place of the multiple optical film. Furthermore, it is possible to use the diamond-like carbon film as a part of an optical film. In the above embodiment, the multiple optical films are formed by applying an evaporation process, and yet, the diamond-like carbon film is formed by applying the screen-mesh plasma-injected CVD process. However, it should be understood that the multiple optical film and the diamond-like carbon film can also be synthesized by applying any proper means other than those processes described above.

It should again be understood that the invention is not solely applicable to the organic photosensitive layer, but identical effects can also be achieved by applying the art of the invention to inorganic photosensitive layers made from Se or a-Si for example.

As is clear from the above description, the invention can provide an extremely durable photosensitive body by effectively forming a diamond-like carbon film having ideally physical characteristics on the top surface of a photosensitive layer, and as a result, the invention offers extremely useful industrial advantages.

As mentioned earlier, the invention does not specify the kind, material and shape of the electrophotographic photosensitive layers, but the invention can widely provide useful effects for any object. In particular, when applying the invention to the electrophotographic photosensitive layer using organic photosensitive material, it extremely improves the resistance against wear, resistance against ozone, and the resistance against light.

In consequence, the invention realizes pollution-free, inexpensive, and extremely durable photosensitive drums, thus significantly contributing to the progress of a variety of electrophotographic apparatuses including copying apparatuses.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A photosensitive body used for an electrophotographic apparatus which employs a light source having wavelengths of 780 nm through 850 nm, comprising:

an electrically conductive substrate:

a photosensitive layer, formed on the electrically conductive substrate, which becomes electrically conductive when irradiated by a light beam;

an optical film layer structure, formed on the photosensitive layer, which absorbs or prevents permeation of light beams having wavelengths of 400 nm through 760 nm, and which permits permeation of light beams having wavelengths of 780 nm through 850 nm; and a diamond-like carbon film, formed on the optical film layer structure, having a surface resistance value of at least $10^{11}\Omega$, a Noop hardness of at least 1000 kg/mm$^2$, and a thickness of 300Å through 5000Å.

2. A photosensitive body as recited in claim 1, wherein said optical film layer structure includes multiple $TiO_2$ and $SiO_2$ layers.

3. A photosensitive body as recited in claim 1, wherein said photosensitive layer includes a charge generating layer and a charge transfer layer.

4. A photosensitive body as recited in claim 2, wherein said photosensitive layer includes a charge generating layer and a charge transfer layer.

* * * * *